US011412802B2

(12) United States Patent
Little

(10) Patent No.: US 11,412,802 B2
(45) Date of Patent: Aug. 16, 2022

(54) SCRUNCH CAP

(71) Applicant: Kylie Little, Benicia, CA (US)

(72) Inventor: Kylie Little, Benicia, CA (US)

( * ) Notice: Subject to any disclaimer, the term of this patent is extended or adjusted under 35 U.S.C. 154(b) by 0 days.

(21) Appl. No.: 17/224,350

(22) Filed: Apr. 7, 2021

(65) Prior Publication Data

US 2022/0007771 A1 Jan. 13, 2022

Related U.S. Application Data

(60) Provisional application No. 63/049,392, filed on Jul. 8, 2020.

(51) Int. Cl.
*A42B 1/041* (2021.01)
*A42B 1/012* (2021.01)

(52) U.S. Cl.
CPC ..... *A42B 1/041* (2013.01); *A42B 1/012* (2021.01)

(58) Field of Classification Search
CPC ..... A42B 1/04; A42B 1/012; A42B 1/049; A42B 1/206; A42B 1/208; A42B 1/22; A42B 1/045; A42B 1/046; A42B 5/00; A42B 7/00; A42B 1/006; A42C 1/00; A41D 23/00
See application file for complete search history.

(56) References Cited

U.S. PATENT DOCUMENTS 1,350,712 A * 8/1920 Goldsmith ..... A42B 1/041 D2/881
1,386,692 A * 8/1921 Dupont ..... A42B 1/045 2/204
1,525,386 A * 2/1925 Hiebl ..... A42B 1/041 2/200.1
2,235,805 A * 3/1941 Susser ..... A42B 1/041 D2/885

(Continued)

FOREIGN PATENT DOCUMENTS

DE 2700703 A1 * 12/1978

OTHER PUBLICATIONS

Women's Surgical Scrub Hats, www.etsy.com, https://www.etsy.com/listing/607692084/womens-surgical-scrub-hats-or-scrub-caps?ga_order=most_relevant&ga_search_type=all&ga_view_type=gallery&ga_search_query=scrub+caps&ref=sr_gallery-1-5&organic_search_click=1&bes=1, [date accessed: Apr. 7, 2021].

(Continued)

*Primary Examiner* — Amy Vanatta
(74) *Attorney, Agent, or Firm* — Houda El-Jarrah; Bold IP, PLLC

(57) ABSTRACT

A scrunch cap that can be compressed and scrunched tight or loosened when worn on the wearer's head. The scrunch cap is adjustable in some embodiments. The scrunch cap is made from a single piece of stretchable fabric. The fabric includes a first and a second long side of generally equal lengths, and a third and a fourth short side of generally equal (Continued)

lengths. A seam is included such that when folded the fabric includes a hemmed side, an unhemmed side opposite the hemmed side, a folded side, and a side opposite the folded side. A plurality of holes is distributed along three sides of the folded stretchable fabric. The folded side of the single piece of stretchable fabric does not include the plurality of holes. A piece of cord or other tying member is threaded through the plurality of holes in a crisscross arrangement and pulled tight.

20 Claims, 14 Drawing Sheets

(56) References Cited

U.S. PATENT DOCUMENTS

| | | | | |
|---|---|---|---|---|
| 2,372,040 | A * | 3/1945 | Wolfe | A41D 23/00 D2/866 |
| 2,414,665 | A * | 1/1947 | Podolsky | A42B 1/004 D2/880 |
| 2,421,654 | A * | 6/1947 | Severin | A42B 1/041 2/207 |
| 2,673,350 | A * | 3/1954 | Chuck | A42B 1/206 2/171.03 |
| 5,249,308 | A * | 10/1993 | Blume | A42B 1/041 34/96 |
| 2005/0144702 | A1 | 7/2005 | Whitney | |
| 2011/0247126 | A1 | 10/2011 | White et al. | |
| 2016/0227865 | A1* | 8/2016 | Roemer | A42B 1/041 |
| 2016/0255895 | A1 | 9/2016 | Shedd | |
| 2017/0027262 | A1* | 2/2017 | Palmer | A42B 1/22 |
| 2020/0000644 | A1 | 1/2020 | Kastros et al. | |

OTHER PUBLICATIONS

Women's EKG Heartbeat Surgical Scrub Hats, www.amazon.com, https://www.amazon.com/DK-Scrub-Hats-Adjustable-Heartbeat/dp/B078SZ3DX3 [date accessed: Apr. 7, 2021].

* cited by examiner

SCRUNCH CAP

CROSS-REFERENCE TO RELATED APPLICATIONS

This application is a non-provisional application which claims priority to U.S. Provisional Patent Application No. 63/049,392 which was filed on Jul. 8, 2020, which is incorporated by reference in its entirety.

FIELD OF THE DISCLOSURE

The present invention relates to a new method and system for creating a flexible, stretchable cap. More specifically, the present invention relates to a method for creating flexible type of scrub caps that cover one's head and hair without being overly tight or uncomfortable, and whose shape and length can be adjusted by the user while worn on the head.

BACKGROUND

Throughout human history, head coverings have been desirable for various reasons. Head coverings are frequently worn at work to prevent hair or other elements from falling into one's face or eyes. In some cases, head coverings are worn, usually by women, who are losing hair for various reasons, including conditions such as cancer. Many people choose to wear head coverings for religious reasons. They may also be worn as a fashionable type of accessory.

Medical personnel such as doctors, nurses, and other types of medical personnel frequently are required to wear scrub caps or surgical caps to cover their hair while working. However, the existing options of scrub caps for medical personnel are not ideal. These existing head coverings, including existing scrub caps, are often times overly tight or overly loose. Additionally, they include an elastic band that leaves a line on the skin and is uncomfortable when worn. Many scrub caps that currently exist require the wearer to fashion their hair in a bun within the scrub cap. The hair cannot be tucked within the cap and remain tucked in place without tying the scrub cap around the bun or bottom part of one's head. Additionally, existing scrub caps or other types of caps do not allow any adjusting of the overall shape and appearance of the scrub cap as they tend to have one single type of look and appearance.

Accordingly, there is a need for an improvement and alternative to the existing scrub caps and other types of head coverings.

SUMMARY

Embodiments are described herein for a scrunch cap or head cover that can be used to cover one's hair for professional reasons (e.g., such as if one is required when working such as many medical professionals including doctors, nurses, and other staff members) and/or personal reasons.

The scrunch cap, as described in one or more non-limiting embodiments, covers fully the hair of the user when the scrunch cap is worn on a user's head, such that a fit of the scrunch cap can be adjusted from being tight fitting to looser fitting by pulling on a back part of the scrunch cap when the scrunch cap is located on the user's head so that the scrunch cap is looser fitting and more voluminous from a back of the user's head.

The scrunch cap, in one or more non-limiting embodiments, may be made from a single piece of stretchable fabric. The single piece of stretchable fabric may initially be cut as a rectangular piece that has a first long side and a second long side having generally equal lengths. The single piece of stretchable fabric may further include a third short side and a fourth short side having generally equal lengths. The scrunch cap may further include a seam, whereby the seam is included on either a first long side or a second long side of the single piece of stretchable fabric. When folded, the single piece of stretchable fabric comprises a hemmed side, an unhemmed side opposite the hemmed side, a folded side, and a side opposite the folded side. The single piece of stretchable fabric may further include a plurality of holes that is distributed along three sides of the folded, single piece of stretchable fabric. The three sides may include the hemmed side, the unhemmed side opposite the hemmed side, and the side opposite the folded side, whereby the folded side of the single piece of stretchable fabric does not include the plurality of holes, and whereby the plurality of holes extend through a top layer and a bottom layer of the folded single piece of stretchable fabric.

A piece of cord or other tying member may be used such that the piece of cord or other tying member is configured to be threaded through the plurality of holes in a crisscross arrangement and pulled tight, such that the single piece of stretchable fabric is scrunched or compressed closer to an end of the single piece of fabric having the piece of rope or other tying member. In some embodiments, the piece of cord or other tying member is configured to be tied shut and tied together so that the size of the cap is non-adjustable. The fit may still be altered in the back of the head by the wearer because the user may pull on the back of the fabric of the scrunch cap to loosen the scrunch cap or pull on the cord in order to compress and shorten the length and volume of the scrunch cap in the back of the head of the wearer.

In other embodiments, the size of the scrunch cap may be adjustable because a toggle (or a buckle or other mechanism) can be added to the longer ends of the cord used to thread through the three sides of the scrunch cap and a user can pull the toggle up or down on the longer ends of the cord in order to adjust the size of the adjustable scrunch cap on the back of the user's head (which may better accommodate wearers who have long hair and/or thicker hair). In other embodiments, a scrunch cap may be adjustable in size because the longer ends of cord are not cut off and/or tied into a bow. Rather, a knot may be created for the cord in one of the holes on one side and then the user can lace the longer ends of cord through the remaining holes in a crisscross arrangement. By pulling on the cord, once the cord has been threaded through the remaining holes in a crisscross arrangement or manner, the user can either loosen or tighten the size of the scrunch cap, and more specifically, the size and fit of the scrunch cap as arranged on the back of the user's head. In one embodiment, the front portion of the scrunch cap is not as adjustable and will remain the same size and shape on the front of the user's head whether the user adjusts the back portion of the scrunch cap or not.

Thus, the scrunch cap can be adjustable in various ways. The term "adjustable" may be used to describe that the back portion of the scrunch cap may be more gathered and pulled together (i.e., scrunched or compressed together) or may be looser and wider and less scrunched in appearance. The term "adjustable" may further be used to indicate that the size and fit of the back portion of the scrunch cap, as described and shown in one or more non-limiting embodiments, may be altered by the user when the lengths of the cord used to tie the scrunch cap are left long and either a toggle (or other mechanism) is added or the user can thread the longer ends of cord through one or more holes on the back portion of the formed scrunch cap and adjust the size and fit of the scrunch cap when worn on the user's head.

A non-limiting method of making the scrunch cap may include providing a single piece of stretchable fabric, wherein the single piece of fabric is rectangular shaped having a first long side and a second long side of generally equal length and a third short side and a fourth short side of generally equal lengths. The method may further include creating a seam along a first long side of the single piece of stretchable fabric and folding the single piece of stretchable fabric in half. When folded, the single piece of stretchable fabric may comprise a top layer and a bottom layer, and further comprise a hemmed side, an unhemmed side opposite the hemmed side, a folded side, and a side opposite the folded side. The method may include forming a plurality of holes distributed along three sides of the single piece of stretchable fabric, the three sides comprising the hemmed side, the unhemmed side opposite the hemmed side, and the side opposite the folded side, wherein the folded side of the single piece of stretchable fabric does not include the plurality of holes. The plurality of holes may extend through the top layer and the bottom layer of the folded single piece of stretchable fabric. The method may also include threading a piece of cord or other tying member through the plurality of holes, wherein the piece of cord or other tying member is threaded in a crisscross arrangement, and further wherein the piece of cord or other tying member is threaded through the plurality of holes along all three sides of the single piece of stretchable fabric. The method may further include pulling a free end of the piece of cord or other tying member tight so that the single piece of stretchable fabric scrunches or compresses together.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1A:
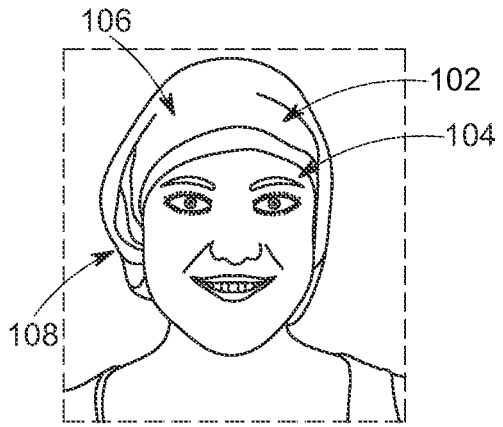
FIG. 1A is a pictorial illustration of a frontal view of a scrunch cap made from a smaller sized piece of fabric in accordance with an illustrative embodiment.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)." this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present description is drawn to an innovative cap that can be worn to cover the head and contain all of the hair of the wearer. In one or more non-limiting embodiments, the cap as described herein solves many of the problems associated with existing caps, especially for those in the medical community who have to wear scrub caps regularly to cover their head and hair while working in a professional and/or medical environment. Some of the most persistent and common felt problems with existing scrub caps include that they are too tight and constricting and when worn for long periods of time cause discomfort to the wearer, including causing headaches, sweating, pimples on the forehead, and other irritation to the head and skin. These scrub caps also can be difficult to keep on because they may be overly loose and fall off repeatedly. Some caps have elastic around the edging of the cap to keep the cap in place, but after a while this elastic causes irritation to the ears and forehead, and a user will thus avoid wearing such elastic caps for long periods of time. Also, the appearance of the vast majority of existing caps (e.g., scrub caps) is not always very flattering to the wearer because the scrub caps have one single look whereby the front and back portions of the cap are tightly positioned and arranged on the head of the wearer without any variation or ability to change the appearance of the cap, especially for the back portion of the cap. While it is possible to find and wear wig caps, wig caps are known for being very tight and uncomfortable to wear for long periods of time. Further, scarves and bandanas need to be tied up or pinned and can be difficult for many people to arrange on their head in an easy and quick manner.

Accordingly, there is a need for a cap that can contain all of the hair of the wearer but can also be worn comfortably for long periods of time by anyone who needs a head/hair covering. The cap can be pulled on one's head similar to a scrub cap, but it may also have the option for alternative appearances, whereby the rear portion of the cap may have a "scrunched" or gathered look whereby the fabric of the cap has body and volume. In one or more non-limiting embodiments, such a cap is described below with reference to the Figures.

A benefit of the cap as described herein is that the cap is made from a single piece of stretchable fabric that provides the elasticity and stretchiness needed. A user can advantageously pull on the back portion of the cap where a set of holes and cord are located if the user wants to stretch out the back portion of the cap further in order to alter the look of the back portion of the cap so that the back portion has more volume and body and may hang a bit looser behind the head. The cap may be worn for professional reasons at work and may also be worn as a fashion accessory or for any other reason that the wearer needs a comfortable yet functional cap to cover their head and hair. Further details are provided below in reference to the Figures.

Figure 1D:
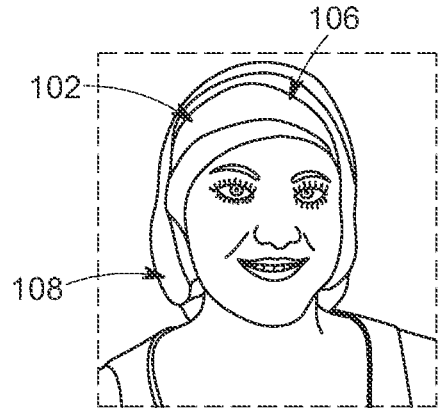
FIG. 1D is a pictorial illustration of a frontal view of a scrunch cap made from a larger sized piece of fabric in accordance with an illustrative embodiment.
Figure 1B:
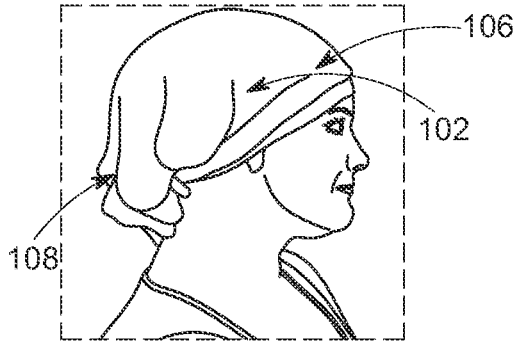
FIG. 1B is a pictorial illustration of a side view of the scrunch cap shown in FIG. 1A in accordance with an illustrative embodiment.
Figure 1E:
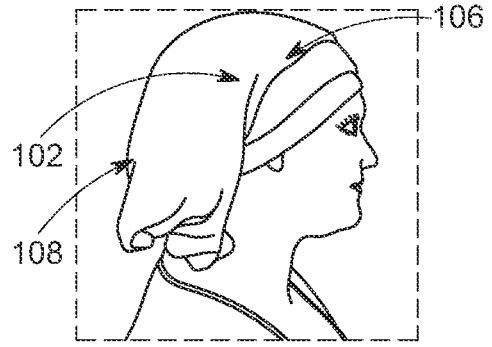
FIG. 1E is a pictorial illustration of the side view of the scrunch cap shown in FIG. 1D in accordance with an illustrative embodiment.
Figure 1C:
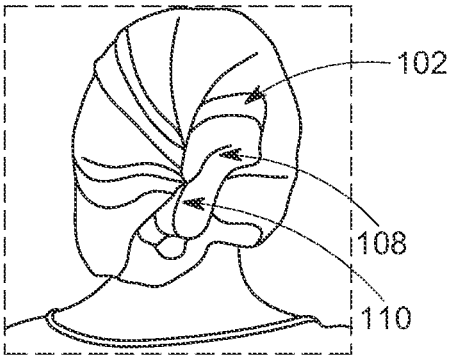
FIG. 1C is a pictorial illustration of a back view of the scrunch cap shown in FIG. 1A in accordance with an illustrative embodiment.
Figure 1F:
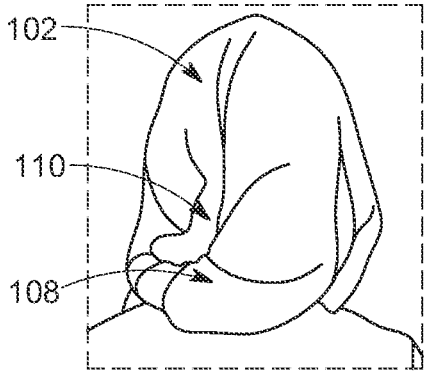
FIG. 1F is a pictorial illustration of a back view of the scrunch cap shown in FIG. 1D in accordance with an illustrative embodiment.

Turning to FIGS. 1A-1F, FIGS. 1A-1F are pictorial illustrations of various views of cap 102 according to one or more non-limiting embodiments. FIGS. 1A-1F show different views of cap 102, which includes a front portion 106 and a back portion 108 and is made of a single piece of fabric (e.g., fabric 402 as shown in FIG. 4). Cap 102 as shown in the figures may be interchangeably referred to herein as a "scrunch cap." The term "scrunch" as used herein may mean "compress" or "compressible" or "shrink" or "retract." Accordingly, the fabric (e.g., fabric 402 shown in FIG. 4) of the scrunch cap 102 is scrunched or compressed together in the rear or back portion 108 of the cap 102 (e.g., see 110 in FIGS. 3A and 3B) while the front portion 106 of the cap 102 remains generally the same and uniform. The scrunching 110 or compressing of cap 102 is also shown in FIG. 1C and FIG. 1F, which provide back views of cap 102. The scrunching 110 of cap 102 is a type of decorative and fashionable technique that makes cap 102 look less like a tight swim cap or wig cap and creates a more decorative, fashionable look that may be appealing to the wearer.

As noted above, medical professionals often wear surgical caps that are tight and compact on the head and do not have additional volume. The cap 102 shown in FIGS. 1A-1F can be worn by medical professionals to cover their head and hair in a work setting but provides a more fashionable alternative to existing scrub caps. Accordingly, cap 102 may be a replacement for a scrub cap in one or more non-limiting embodiments. It is noted that cap 102 is not limited to be worn by medical professionals or only those in a medical setting. Cap 102 may be worn for any reason and by any person, including male or female. Cap 102 may be desirable to any wearer who wants to cover his or her hair and head.

FIGS. 1A-1C are pictorial illustrations showing a cap 102 created from a smaller piece of fabric, while FIGS. 1D-1F are pictorial illustrations showing a cap 102 created from a larger piece of fabric. The difference is apparent in FIGS. 1D-1F that with a larger piece of fabric the back portion 108 of the cap 102 may have more volume and body and appear to have more material hanging from the back portion 108 of the cap 102 when worn on a user's head 104. The front portion 106 of the cap 102, when worn on the user's head 104, may cover most of the forehead, as well as the head as a whole, including the ears if desired by the user. It is noted that whether the fabric (e.g., fabric 402 shown in FIG. 4) used to make the scrunch cap 102 is smaller or larger in size, the method for making and forming the scrunch cap 102 allows the user to scrunch (e.g., scrunch 110) the scrunch cap 102 as desired or to pull on with one's fingers and loosen the fabric in the back portion 108 of the scrunch cap 102 to have a looser look to the scrunch cap 102 with more body and volume. The user may desire to have a looser looking scrunch cap 102 in the back portion 108 as the user may feel this look is more appealing to the user's face and overall appearance. Conversely, the user may desire a tighter, more scrunched or compressed look to the scrunch cap 102 if they prefer such a look for the user's face and overall appearance.

Figure 2:
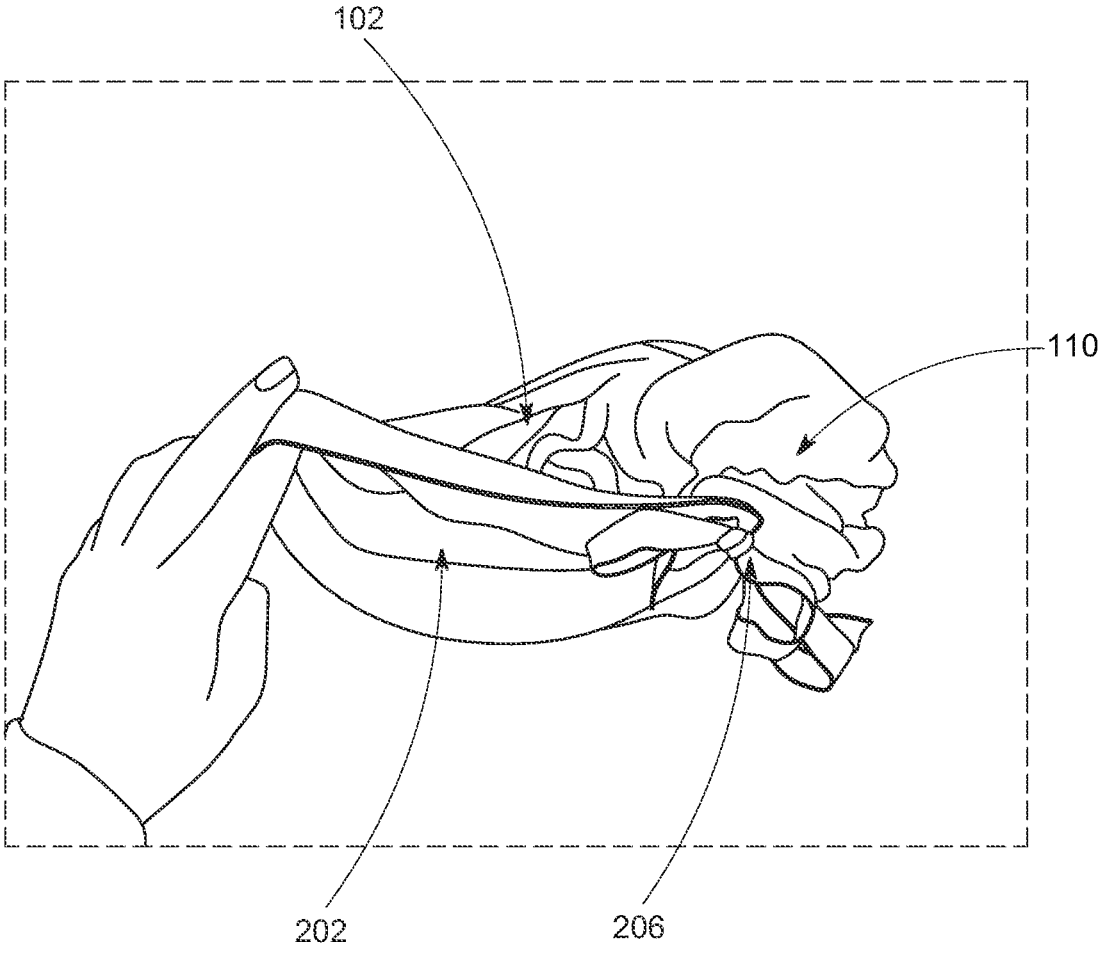
FIG. 2 is a pictorial illustration of a side view of a scrunch cap in accordance with an illustrative embodiment.

Turning to FIG. 2, cap 102 includes an opening 202 for the user's head 104 to be inserted in the head opening 202 formed on the underside of the cap 102 when the cap 102 is fully assembled. The user may pull the assembled cap 102 on their head 104 by inserting the user's head 104 into the opening 202 of the cap 102. This may include gathering any hair the user has and tucking it into the opening 202 on the underside of the cap 102, especially when the user has longer hair.

In one or more non-limiting embodiments, cap 102 may include a cord 204 that may be used to tie the cap 102 together. This tying process may be further explained below with relation to FIGS. 10-13. Cord 204 may be any type of tying member that can be tied, and is not limited to cords but, may also include lace, string, rope, thread, or any other type of member that can be used in place of cord 204 to tie the different sides of the fabric of the cap 102 together (e.g., as further shown in FIGS. 8-9).

FIG. 2 further shows the scrunching 110 of the fabric of the cap 102 in the back portion 108 of the cap 102 when the cap 102 is assembled and cord 204 is pulled and tied together. Cord 204 may be a single, long piece of cord 204 or other tying member and may include two separate ends.

When tied, cord 204 may be tied into a decorative bow 206 in one or more non-limiting embodiments which may be visually appealing. It is noted that the bow 206 can be tucked into the underside of the cap 102 if the wearer does not want the bow 206 to be visible. Alternatively, cord 204 does not have to be tied into a bow 206 and any excess ends of the cord 204 may be tucked into the underside of the cap 102 so as not to be visible.

Figure 3A:
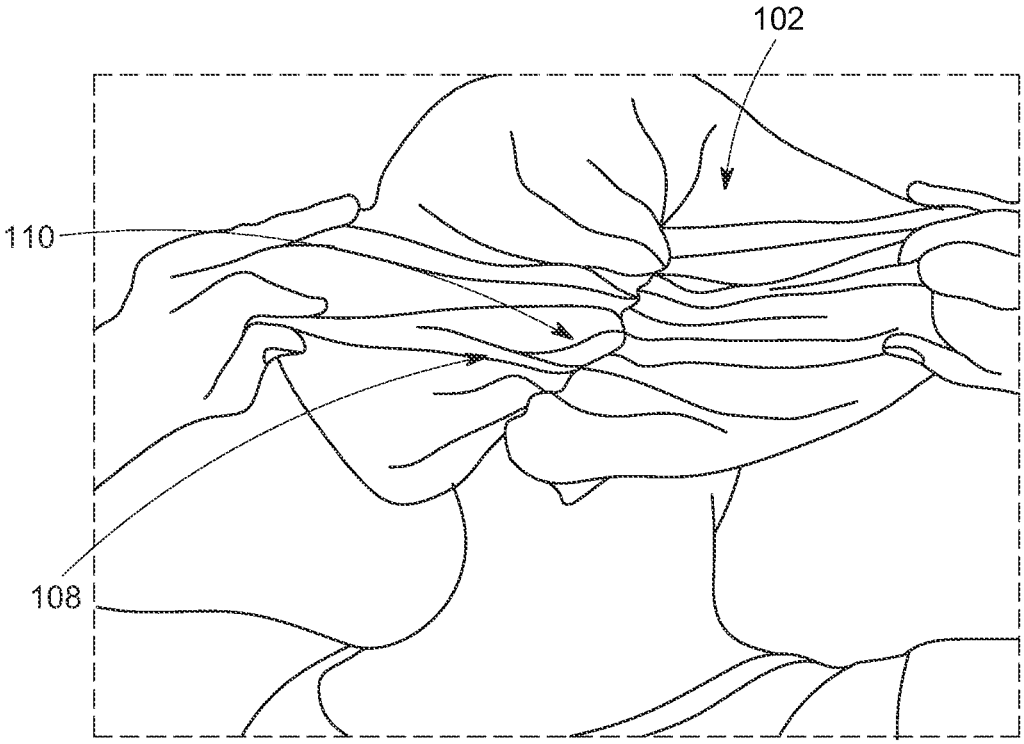
FIG. 3A is a pictorial illustration of a back view of a scrunch cap in accordance with an illustrative embodiment.
Figure 3B:
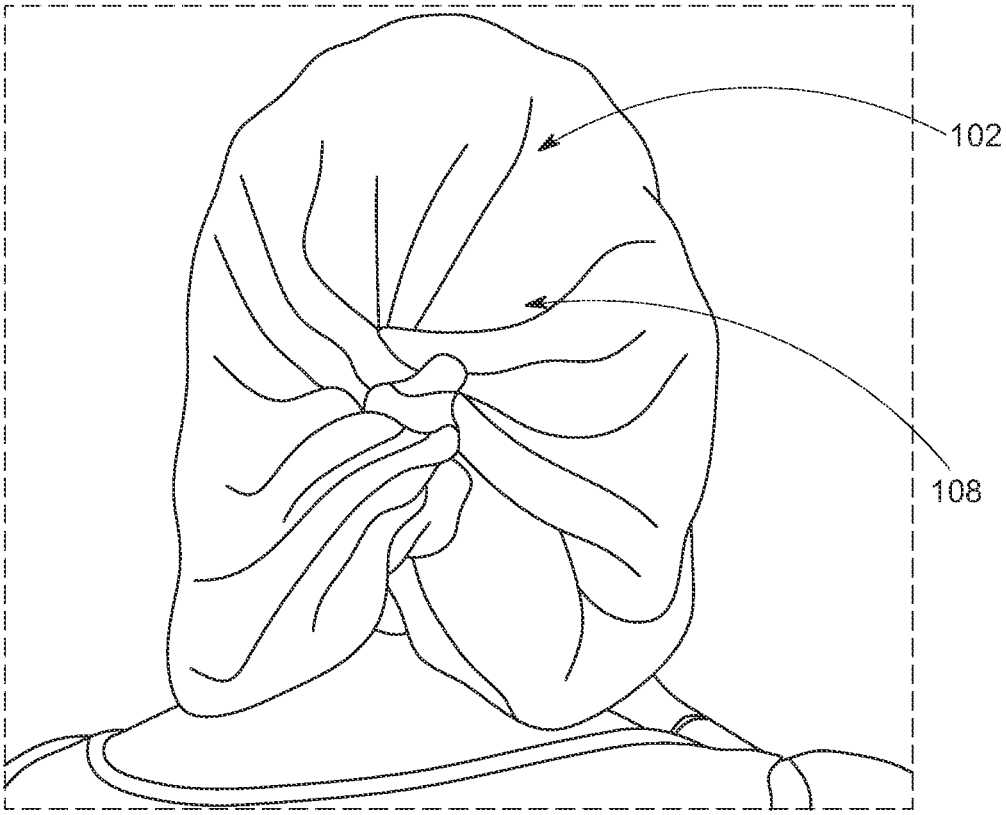
FIG. 3B is a pictorial illustration of the back view of the scrunch cap shown in FIG. 3A in accordance with an illustrative embodiment.
Figure 4:
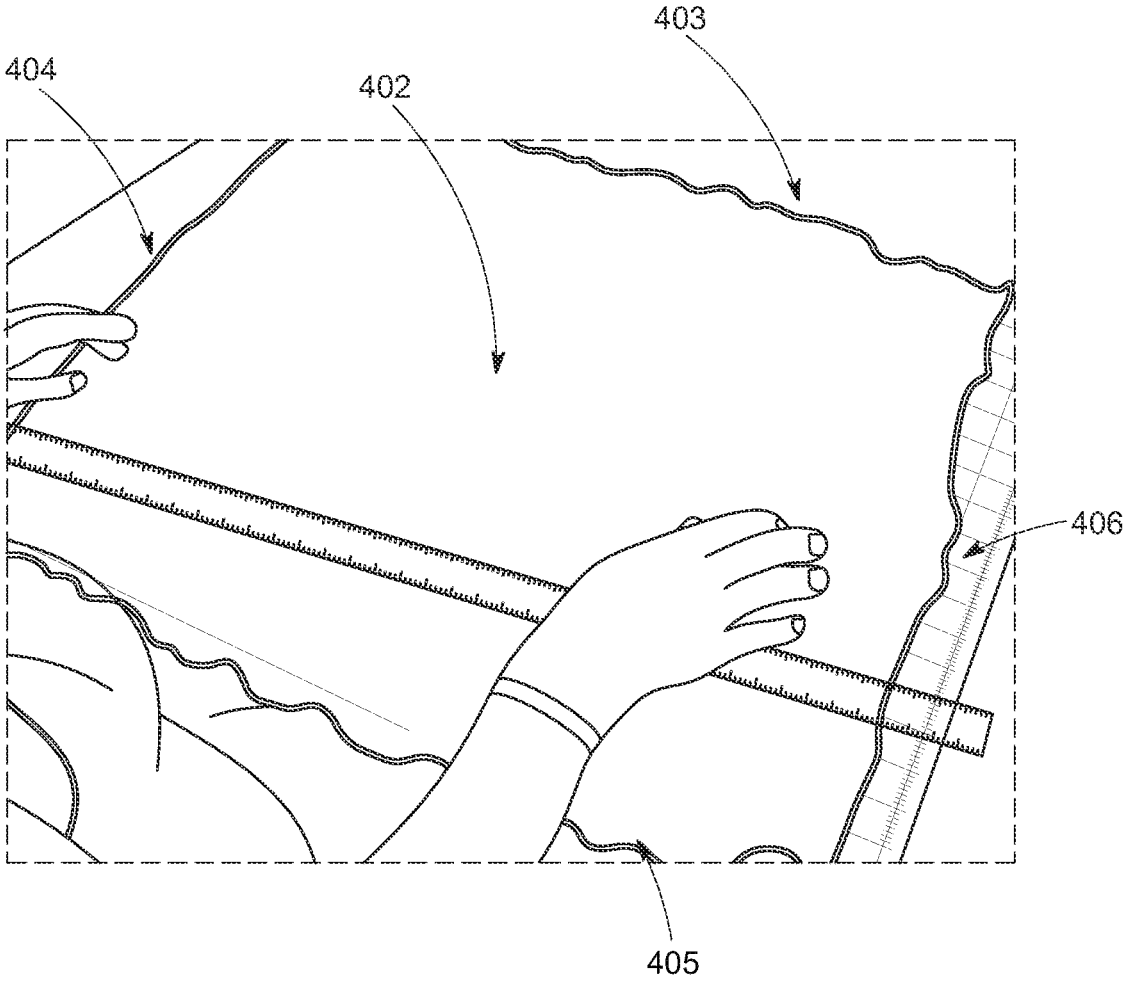
FIG. 4 is a pictorial illustration of a rectangular shaped single piece of stretchable fabric in accordance with an illustrative embodiment.

Turning to FIG. 3A and FIG. 3B, FIG. 3A and FIG. 3B provide a pictorial illustration showing a back view of the cap 102. FIG. 3A shows that if the user pulls on each side of the back portion 108 of cap 102 with their hands, the user can stretch out or loosen the scrunching 110 of the fabric of the cap 102 in the back portion 108 of the cap 102. This pulling and loosening of the back portion 108 of the cap 102 may cause the back portion 108 of the cap 102 to hang looser and have more volume and body. The cap 102 can thus be tightly scrunched together or loosely scrunched together as desired by the user.

When the user wants to tighten the fabric of the cap 102 in the back portion 108 of the cap 102, the user may pull on the end of the cord 204 to pull the fabric of the cap 102 closer together. Thus, the user has the option to tighten and loosen the fabric of the cap 102 in the back portion 108 of the cap 102 by either pulling on the fabric of the cap 102 in the back portion 108 of the cap 102 or pulling on the end of the cord 204 to tighten the fabric further so the back portion 108 of the cap 102 does not look like it hangs as loosely.

Turning to FIG. 4, FIG. 4 shows a pictorial illustration of fabric that may be used to create cap 102. The cap 102 is created, in one or more non-limiting embodiments, from a single piece of stretchable fabric, such as the single piece of fabric 402 shown in FIG. 4. The fabric for the single piece of fabric 402 may be made from a variety of materials, but ones that preferably are somewhat stretchable. Examples of such fabrics may include, but are not limited to, knit fabrics, spandex, spandex blends, stretch satin, stretch denim, cotton poplin stretch, stretch lace, or stretch velvet to name a few. The knit fabrics may include different knit fabrics such as bamboo jersey knit, double knit rayon blend knit, interlock twist jersey kits, double knits, silk mesh knits, or silk jersey. Spandex blends may include, but are not limited to, cotton spandex blends, polyester spandex blends, nylon spandex blends, or rayon knit spandex blends. Cap 102 may be created from a variety of fabrics, including those mentioned above. The fabrics may have any color or pattern as desired by the user. Further, cord 204 may also be provided having any color or pattern as desired by the user. In one or more non-limiting embodiments, decorative elements may be added to the fabric 402 including but not limited to beads, jewels, pins, or the like.

Turning to FIGS. 4-13, FIGS. 4-13 may provide illustrations that clarify how cap 102 may be made in accordance with one or more non-limiting embodiments. As shown in FIG. 4, the single piece of fabric 402 may be cut into a generally rectangular shape having four sides, such as side 403, side 404, side 405, and side 406. The sides 403 and 405, which are opposite each other, may generally be cut to have the same length. Similarly, sides 404 and 406 may be formed having generally equal lengths. Other shapes other than rectangular shapes may also be used for single piece of fabric 402.

In one or more non-limiting embodiments, single piece of fabric 402 may be run through a Serger machine or overlock machine (not shown) to make the sides 403, 404, 405, 406 uniform and even. The Serger machine, as known in the art, sews a seam, finishes an edge, and trims excess fabric which may be beneficial for creating a uniform rectangular piece of fabric 402 and the correct lengths for each side 403, 404, 405, and 406. In a non-limiting embodiment, the single piece of stretchable fabric 402 is generally rectangular in shape and has a first long side 403 and a second long side 405 that are opposite each other and have generally equal lengths. Further, the single piece of stretchable fabric 402 may include a third short side 404 and a fourth short side 406 of generally equal lengths.

Figure 5:
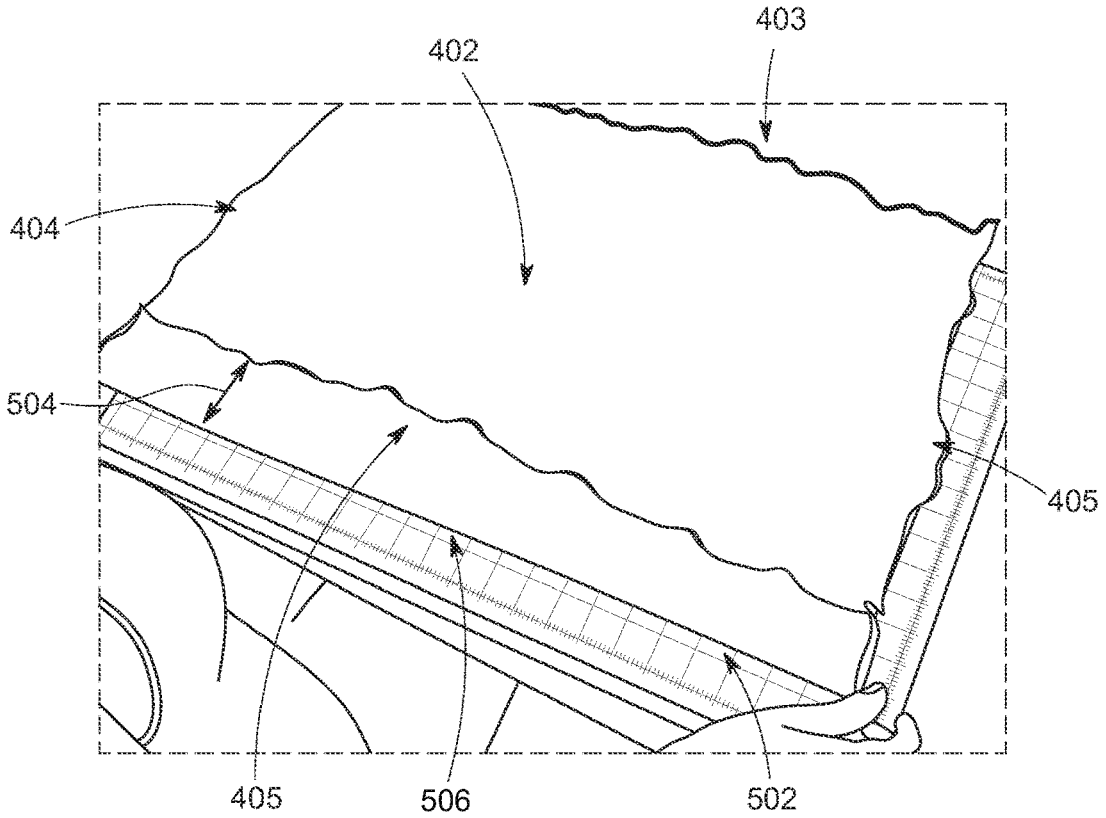
FIG. 5 is a pictorial illustration of a portion of the single piece of stretchable fabric folded over to create a seam in accordance with an illustrative embodiment.
Figure 6:
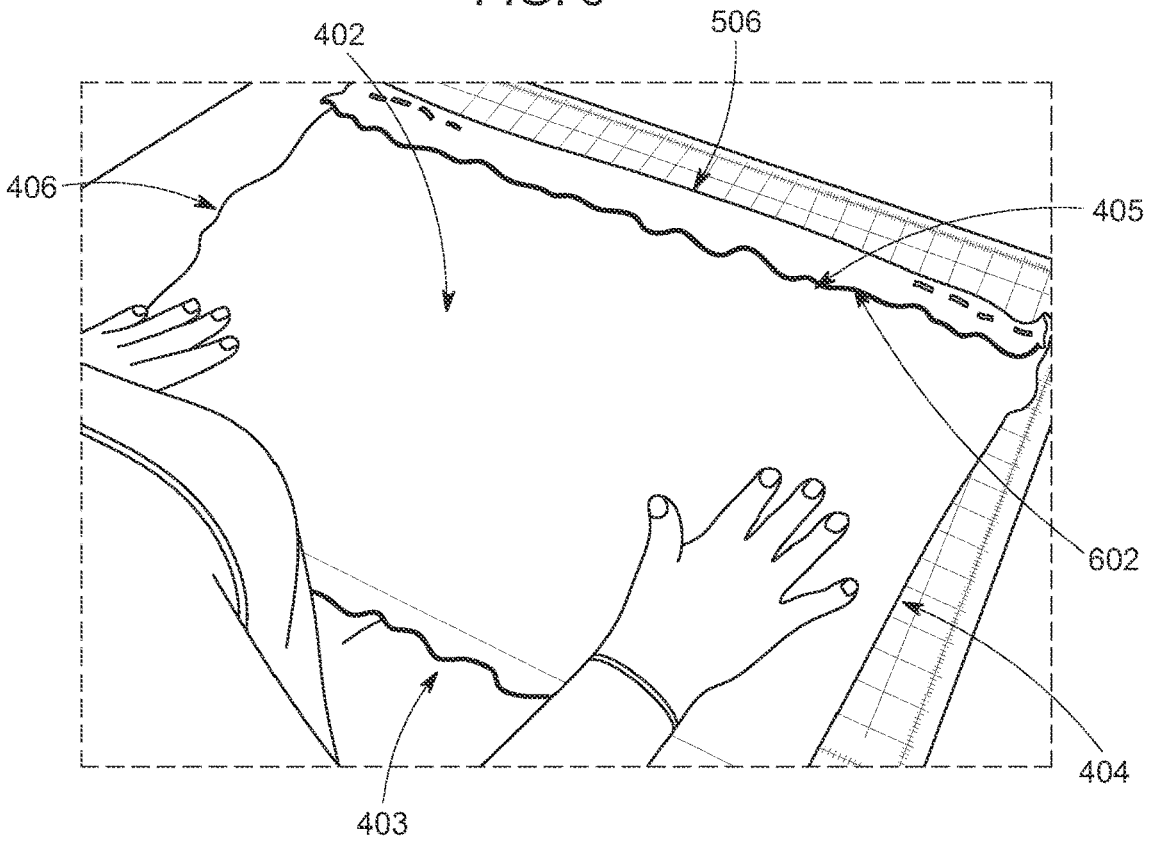
FIG. 6 is a pictorial illustration of a seam in the single piece of stretchable fabric in accordance with an illustrative embodiment.

In one or more non-limiting embodiment, the process of making cap 102 may include adding a seam to fabric 402. FIG. 5 shows a pictorial illustration of single piece of fabric 402 having a portion 502 of the single piece of fabric 402 folded over in order to create a seam, such as seam 602 as shown in FIG. 6. Seam 602 is where two or more layers of fabric 402 are joined and held together via stitches or other means of attachment.

The folded over portion 502 of the single piece of fabric 402 may be made by folding over a longer side of the single piece of fabric 402, which may include long side 403 or long side 405 as shown in FIG. 4. The folded over portion 502 of the single piece of fabric 402 may have a pre-determined width 504 as shown in FIG. 5. The width 504 for forming the seam 602, in one or more non-limiting embodiments, may be at least one inch from a nearby edge 506 of the single piece of fabric 402. One of ordinary skill in the art may understand that other widths 504 may alternatively be used.

Figure 7:
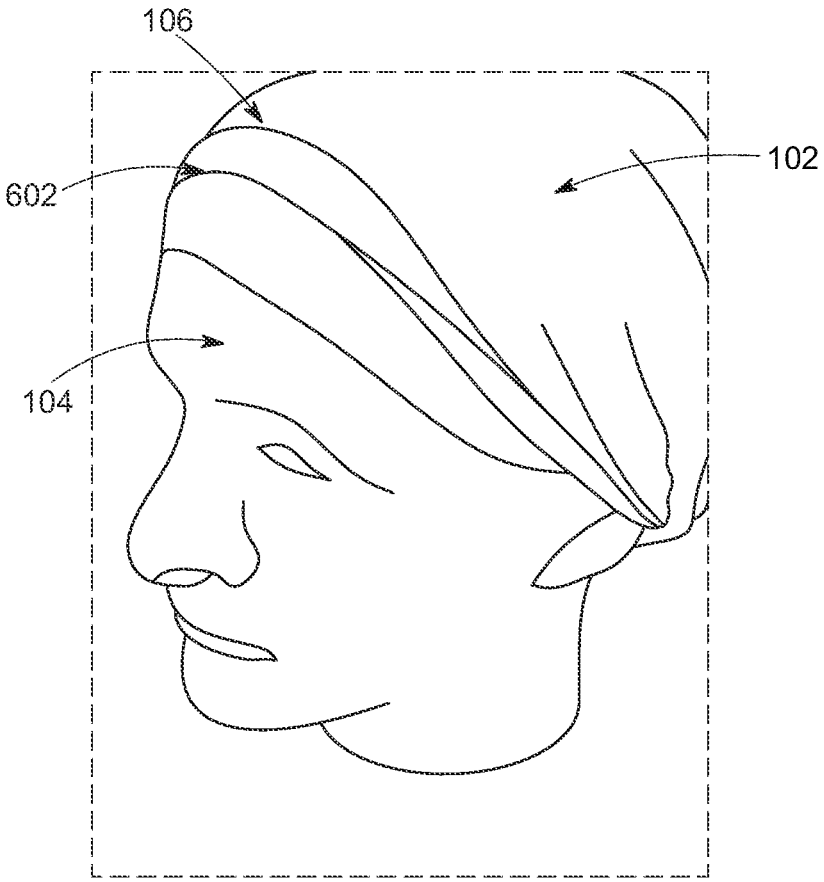
FIG. 7 is a pictorial illustration of a front view of a scrunch cap with a seam located in the front portion of the scrunch cap in accordance with an illustrative embodiment.

Turning to FIG. 7, FIG. 7 shows a completed cap 102 with a close-up view of the front portion 106 of the cap 102. The seam 602 is clearly visible in FIG. 7 and may extend along a front portion 106 of the cap having the desired width 504 as shown in FIG. 5. The seam 602 may extend along the front portion of the cap 106 and may be proximate to an edge (e.g., edge 506) of the cap 102 that is in contact with the forehead of the user when the cap 102 is worn on the user's head 104.

There are many ways seam 602 can be created as those of ordinary skill in the art will comprehend. In a preferred embodiment, seam 602 may be sewed into the single piece of rectangular fabric 402 in one or more non-limiting embodiments using a sewing machine or the like. Sewing the seam 602 into place creates a straight, clean line along the top portion of the single piece of fabric 402 as shown in FIG. 6 without the stitching being overly visible.

In a non-limiting alternative embodiment, a double-sided adhesive may be used to create seam 602. An example of a usable double-sided adhesive is HEATNBOND in one or more non-limiting embodiments. HEATNBOND comes in as a roll of paper backed, iron-on, double-sided adhesive for bonding fabric without the need for pinning or sewing. Accordingly, the user may cut a desired amount of the double-sided adhesive and locate the double-sided adhesive along a long side 405 of the single piece of fabric 402. The user may then fold over the desired amount of fabric to create the seam 602 having the desired width 504 from the edge 506 of the fabric 402. By folding over and gluing the two sides of fabric 402 together, a user may create a seam 602.

Figure 8:
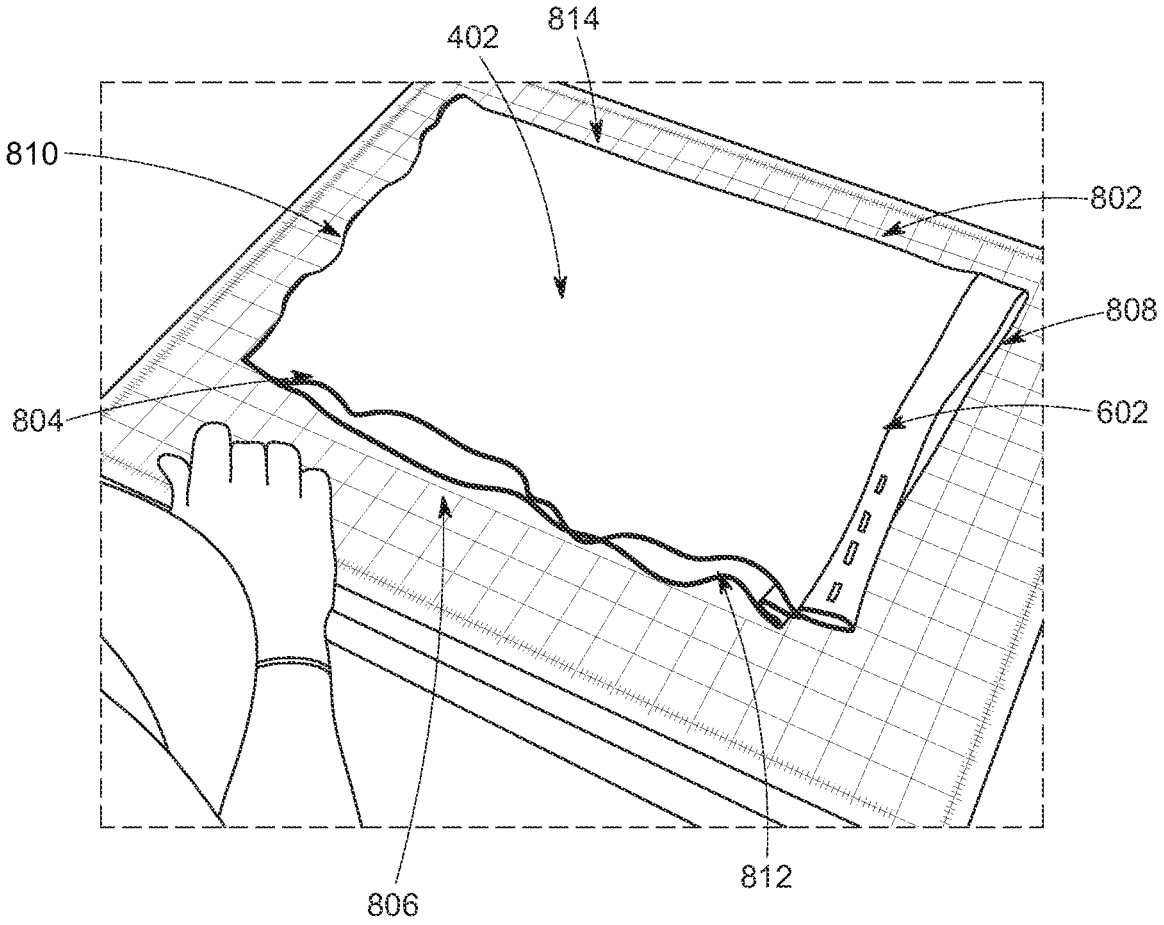
FIG. 8 is a pictorial illustration of the single piece of stretchable fabric folded in half in accordance with an illustrative embodiment.

Turning to FIG. 8, FIG. 8 may show another step in the process for creating cap 102 according to one or more non-limiting embodiments. In a non-limiting embodiment, after creating the seam 602, the user may fold the single piece of fabric 402 in half as shown in FIG. 8 thereby creating a fold 802 in the single piece of fabric 402. When folded, the single piece of fabric 402 may include a top layer 804 and a bottom layer 806. Further, when folded, the single piece of fabric 402 may include a long, hemmed side 808 and a long, unhemmed side 810, whereby the long, hemmed side 808 and the long, unhemmed side 810 are opposite one another. The hemmed side 808 includes the seam 602 in the top layer 804 and bottom layer 806 of the folded piece of fabric 402.

When folded, the single piece of fabric 402 may include an unhemmed shorter side 812, and a folded side 814 opposite the unhemmed shorter side 812. The folding in half of the single piece of fabric 402 may occur by folding side 404 to side 406 or side 406 to 404 as shown in FIG. 5-6.

Figure 9:
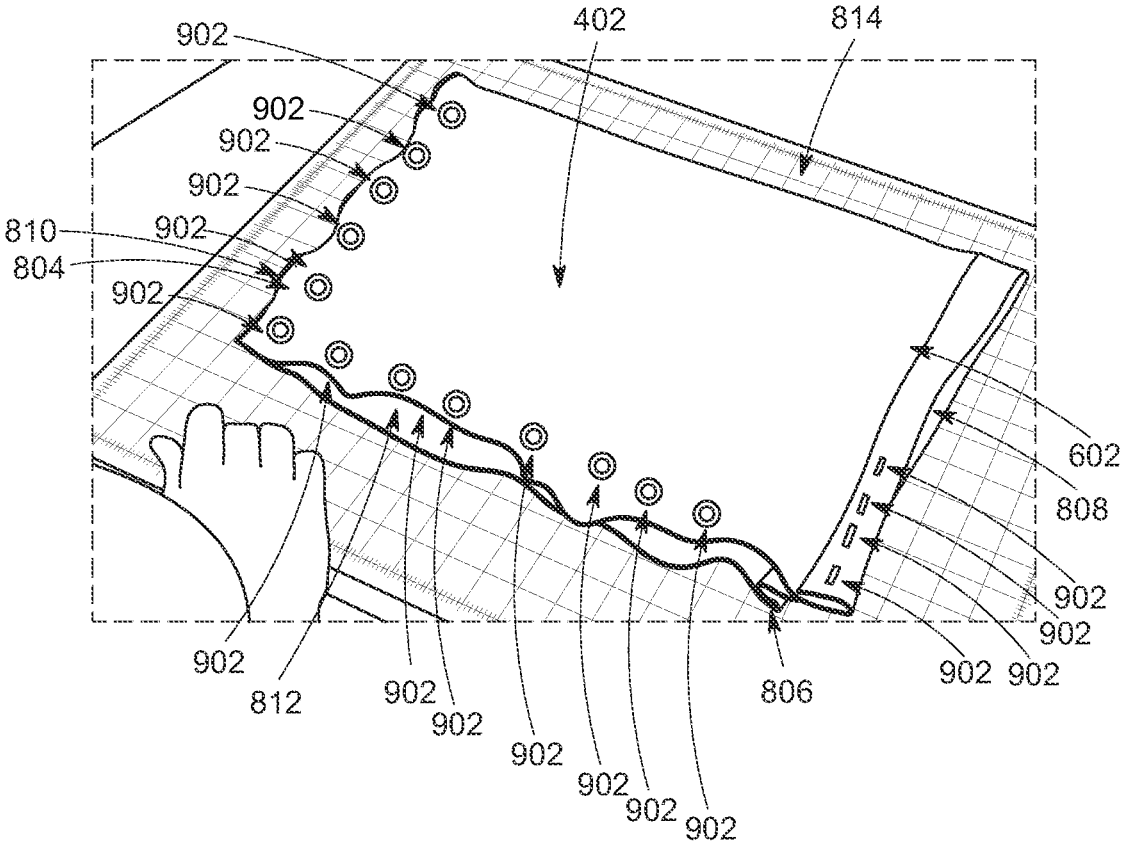
FIG. 9 is a pictorial illustration of a plurality of holes located in the folded piece of stretchable fabric in accordance with an illustrative embodiment.

When the single piece of fabric 402 has been folded, the next step may include forming a plurality of holes, such as plurality of holes 902 shown in FIG. 9. The size of the circle symbols used to represent the plurality of holes 902 in FIG. 9 are enlarged and exaggerated for purposes of showing approximately how the plurality of holes 902 may be placed and distributed. The actual size of plurality of holes 902 may be relatively small in size and not overly visible. The plurality of holes 902 is meant to be the holes that the cord 204 or another tying member is threaded through. The hole size of each of the plurality of holes 902 needs to accommodate cord 204, which may be very small in diameter.

In one or more non-limiting embodiment, the plurality of holes 902 may be located alongside 810, side 812, and side 808 of the single piece of fabric 402 when folded as shown in FIG. 9. Notably, the plurality of holes 902 are not included along the folded side 814 of the single piece of fabric 402 in one or more non-limiting embodiments.

In one or more non-limiting embodiments, each hole 902 of the plurality of holes 902 may be approximately 1 inch apart, and preferably no more than two inches apart. In one non-limiting embodiment, at least seven holes 902 may be distributed on side 810 and 812 of the folded single piece of fabric 402, while side 808 of the single piece of fabric 402 may have less holes 902. In a non-limiting embodiment, the folded single piece of fabric 402 may include four holes 902 on side 808 as shown in FIG. 9. One of ordinary skill in the art will appreciate that more or less holes 902 may be located on any of these sides 808, 810, and 812 in alternative embodiments. Each hole 902 of the plurality of holes 902 extends through the top layer 804 and bottom layer 806 of the folded single piece of fabric 402. Accordingly, when unfolded, side 808 may appear to have 8 holes in one or more non-limiting embodiments.

In one or more non-limiting embodiments, the plurality of holes 902 may be created by marking and then cutting small holes 902 into the top layer 804 and bottom layer 806 of the folded single piece of fabric 402. The holes 902 may be cut in the fabric 402 using any preferred cutting implement or method of making holes 902. The holes 902 on the top layer 804 and bottom layer 806 are aligned.

In one or more non-limiting embodiments, the plurality of holes 902 may be reinforced by forming or sewing the holes 902 as buttonholes, which are shown on side 808 in FIG. 9. All of the plurality of holes 902 may be reinforced as buttonholes, however, in one or more non-limiting embodiments, only the holes 902 located on the side 808 may be reinforced by sewing the holes as buttonholes as shown in FIG. 9. This may be because the holes 902 alongside 808 are going to be the holes 902 located on the back portion 108 of the cap 102, and these holes 902 may experience more wear and tear than the other holes 902. Accordingly, it may be beneficial to reinforce these holes 902 by sewing them as buttonholes rather than only cutting and creating holes 902 in the top layer 804 and bottom layer 806 of the folded single piece of fabric 402. Accordingly, the plurality of holes 902 are located along three sides (e.g., side 808, 810, and 812), but not along the folded side (e.g., 814) of the folded piece of fabric 402.

Figure 10:
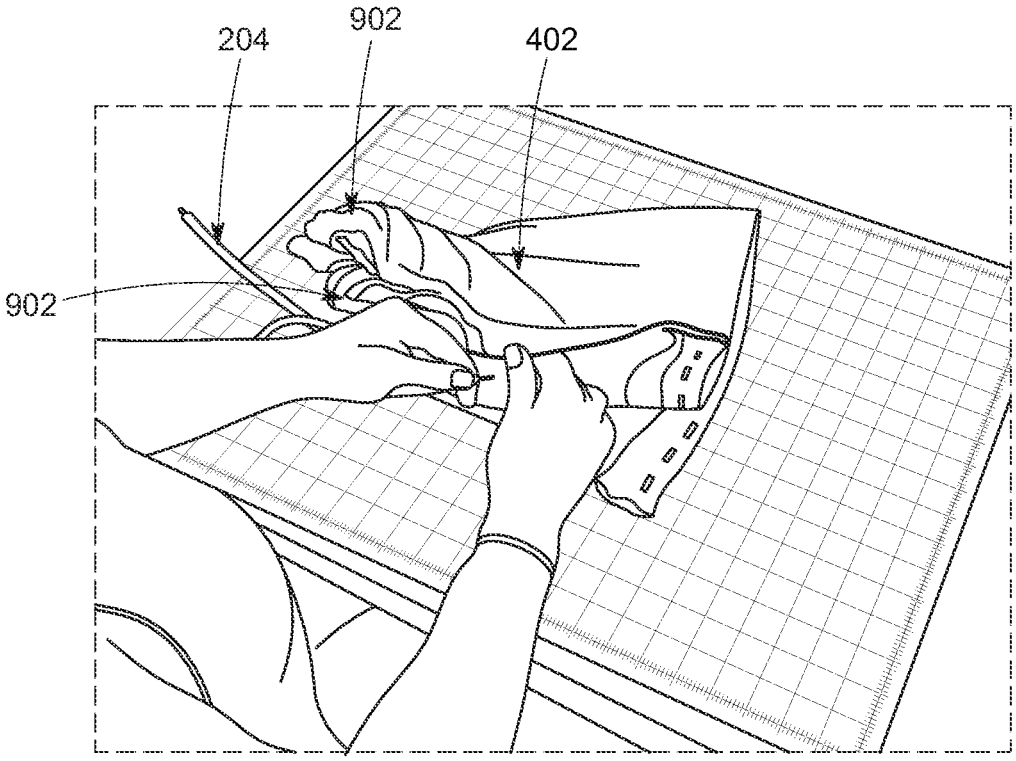
FIG. 10 is a pictorial illustration of a cord or rope being laced through the plurality of holes in the folded piece of stretchable fabric in accordance with an illustrative embodiment.
Figure 12:
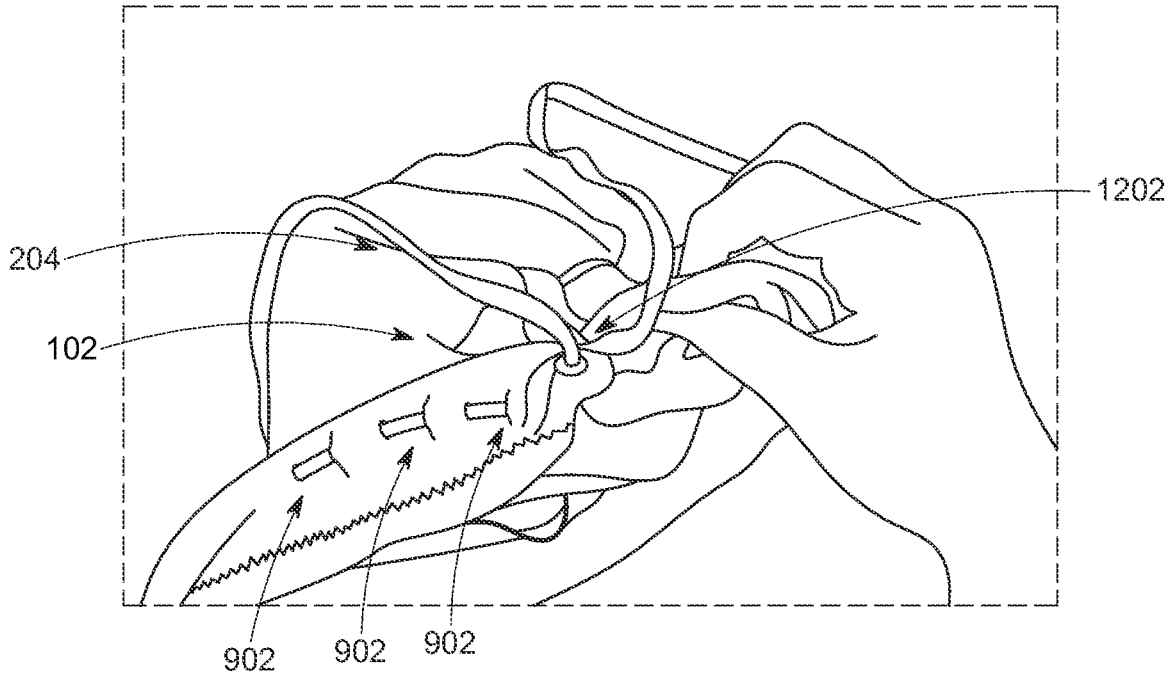
FIG. 12 is a pictorial illustration of a back view of the scrunch cap with a cord located through some of the plurality of holes in accordance with an illustrative embodiment.

Turning to FIG. 10, FIG. 10 shows a piece of cord 204 being threaded through the plurality of holes 902. The cord 204 may be threaded in a crisscross manner (e.g., crisscross arrangement 1304 as shown in FIG. 12) in one or more non-limiting embodiments through each hole 902. The holes 902 located on the same sides (e.g., side 808, 810, 812) of the fabric 402 are laced at the same time alternating from the top layer 804 to the bottom layer 804. Thus, the cord 204 is first threaded through one side, such as side 810, then the next adjacent side having a plurality of holes 902 which is side 812, and then the side adjacent to side 812, which is side 808, whereby 808 is also the hemmed side. Alternatively, in another non-limiting embodiment, the cord 204 may be first threaded through side 808, then the next adjacent side 812, and then side 810.

Figure 11:
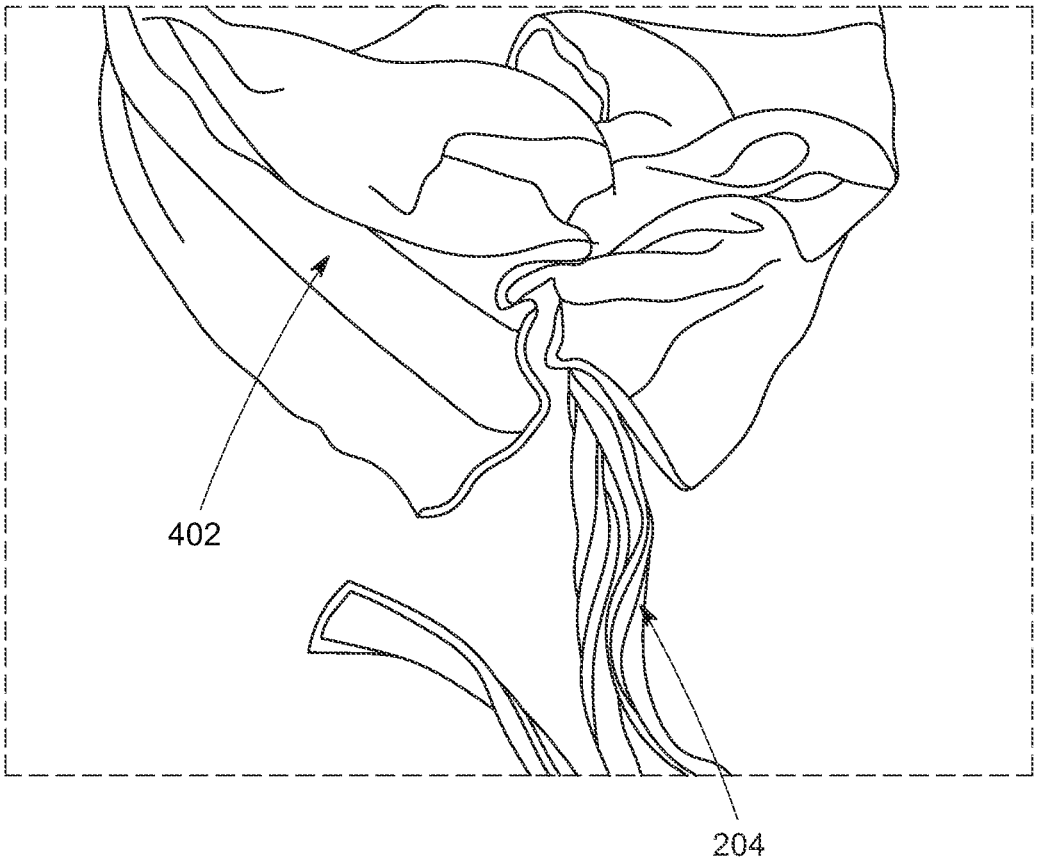
FIG. 11 is a pictorial illustration of a cap formed after lacing all of the holes in the folded piece of stretchable fabric in accordance with an illustrative embodiment.

Turning to FIG. 11, FIG. 11 illustrates how a cap 102 is formed after the lacing of the plurality of holes 902 is complete. Once the threading of the cord 204 through all of the plurality of holes 902 in a crisscross arrangement has been completed, then the cord 204 can be pulled on so that the single piece of fabric 402 scrunches or compresses together. Pulling the two free ends of the cord 204 together and pulling the cord 204 through all of the plurality of holes 902 causes all of the sides of the cap 102 to "scrunch" or gather together thereby forming the scrunch cap 102. Accordingly, the single piece of fabric 402 when scrunched together (upon the pulling of the cord 204 through the plurality of holes 902 simultaneously) causes the cap 102 to be formed and wearable by the user. The head hole or opening 202 is created on the underside of the cap 102 and the wearer is able to insert their head directly in the head hole or opening 202. After the holes 902 are all laced, the head opening 202 may have approximately a sixteen-inch circumference for a standard size cap 102 in one or more non-limiting embodiment.

In one non-limiting embodiment, cap 102 may be described as either being a "standard size" "non-adjustable." The "standard size" or "non-adjustable" cap 102 may be characterized in that any excess of the cord 204 at the back may be cut off and sewn short to make this portion less visible when worn. The wearer will not be able to adjust the ties in this standard size or non-adjustable embodiment of the scrunch cap 102. Rather, the cap 102 will be ready to wear by slipping the cap 102 on the user's head and tucking any extra hair into the underside of the cap 102 (e.g., head opening 202 as shown in FIG. 2). In one non-limiting embodiment, the cord 204 can be pulled and then tied in a knot close to the back portion 108 of the formed cap 102. Alternatively, any excess amount of cord 204 that dangles from the cap 102 can be formed into a decorative bow, such as the bow 206 shown in FIG. 2. The user may still pull on the back portion 108 of the scrunch cap 102 to make the scrunch cap 102 look looser and fuller with more body and volume (e.g., as shown in FIGS. 1C and 1F), or may pull on the ties once more to pull the scrunch cap 102 back together and tighten to have a more scrunched, compressed look in the back of the scrunch cap 102 (e.g., as shown in FIGS. 1B and 1E)

Figure 13:
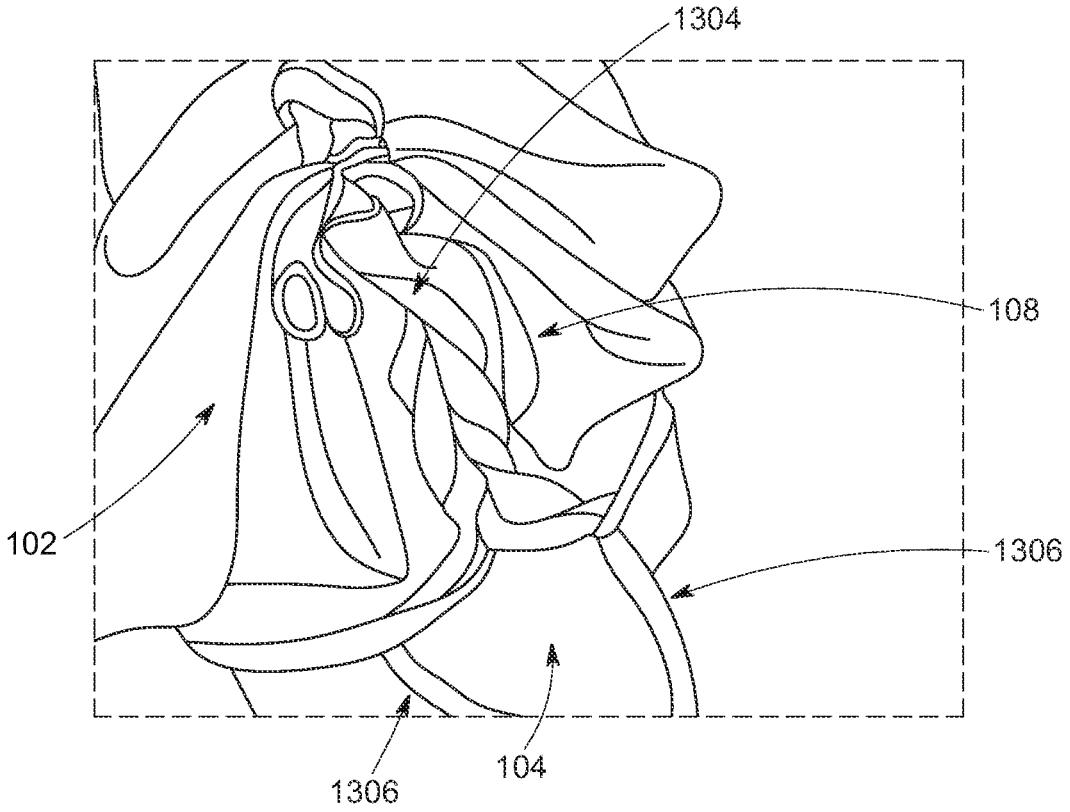
FIG. 13 is a pictorial illustration of a back view of the scrunch cap with a cord located through the plurality of holes in accordance with an illustrative embodiment.

If it is desired that the user of the cap 102 can adjust the overall size of the cap 102 to their liking. FIGS. 12-13 may illustrate the process for making the size of the scrunch cap 102 more adjustable to the wearer by allowing the size of the cap 102 to be adjusted by the user depending on the lacing of the cord 204 in the holes 902, as shown in FIGS. 12-13.

As shown in FIGS. 12-13, in one or more non-limiting embodiments, the cord 204 may be threaded through all of the plurality of the holes 902. In one or more non-limiting embodiments, the cord 204 may range from 24 to 36 inches in length (although other dimensions may alternatively be used). It may be helpful to use this range of length for the cord 204 to make the lacing of holes 902 in the piece of fabric 402 easier.

In the adjustable size cap 102 shown in FIGS. 12-13, any excess amount of the cord 204 after lacing all the holes 902 can be kept and be used to loosen or tighten the amount of cord 204 between those last few holes 902 remaining on the hemmed side 808 to adjust the size of the cap 102. Next, the two ends of cord 204 may be tied in a knot at a top hole 1202 in the back portion 108 of the formed cap 102, whereby the top hole 1202 is shown in FIG. 12. Top hole 1202 may be one of the designated holes 902 located on the hemmed side 808 of the folded piece of fabric 402 for a knot to be tied as shown in FIG. 12. It is noted that the holes 902 positioned on the hemmed side 808 may be reinforced as buttonholes in one or more non-limiting embodiments because these holes 902 on hemmed side 808 are intended to be positioned on the back portion 108 of the formed cap 102 and it may be beneficial for the holes 902 to be more sturdy and less prone to tearing by being reinforced as buttonholes. Further, in one or more non-limiting embodiments, the plurality of holes 902 on the hemmed side 808 are the last set of holes 902 to be laced via the cord 204 or another tying member through the top layer 804 and the bottom layer 806.

Next, the remainder of the cord 204 may be threaded in a crisscross arrangement 1304 as shown in FIG. 13 through the remaining holes 902 on this back portion 108 of the formed cap 102 or the hemmed side 808 of the folded piece of fabric 404. Notably, instead of tying the two ends of the cord 204 together and pulling the two ends of the cord 204 tight to compress the fabric 402, the maker of the cap 102 leaves the two ends of the cord 204 untied. This may allow the back portion 108 of the cap 102 to be looser and adjustable so that when the user wants to wear the cap 102, he or she can place the cap 102 on his or her head, gather all of their hair within the interior of the cap 102, and then tie the two ends 1306 of the cord 204 together themselves so as to make the cap 102 fit as tight or as loosely as the user desires.

Figure 14:
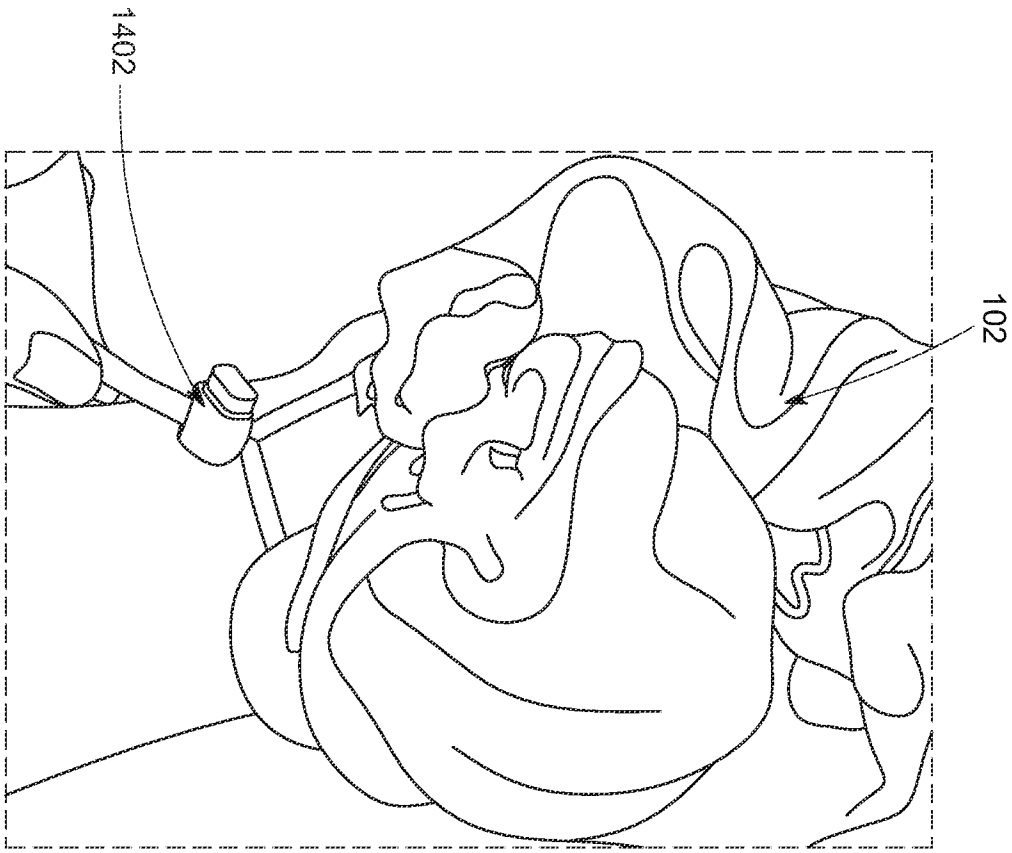
FIG. 14 is a pictorial illustration of a back view of the scrunch cap with a toggle added to the scrunch cap in accordance with an illustrative embodiment.

To further make the size and fit of the scrunch cap 102 more adjustable in nature, FIG. 14 further shows an example where a toggle, such as toggle 1402, may be added to the remaining excess ends of the cord 204 to also adjust the tightness or looseness of the formed scrunch cap 102. The toggle 1402 is added to the excess ends of the cord 204 (that are not cut short) and the toggle 1402 may be pulled up or down or otherwise manipulated along the excess ends of the cord 204 by the user to adjust the tightness of the cord 204 and overall tightness of the scrunch cap 102. The toggle 1402 may be used for both the "standard size" or "adjustable size" scrunch cap 102 and for the non-adjustable model in one or more non-limiting embodiments. Further, it is noted that other tightening and loosening mechanisms or items may be used other than toggle 1402, in other embodiments, including buckles, straps, buttons, zippers, or any other item known in the art.

Figure 15:
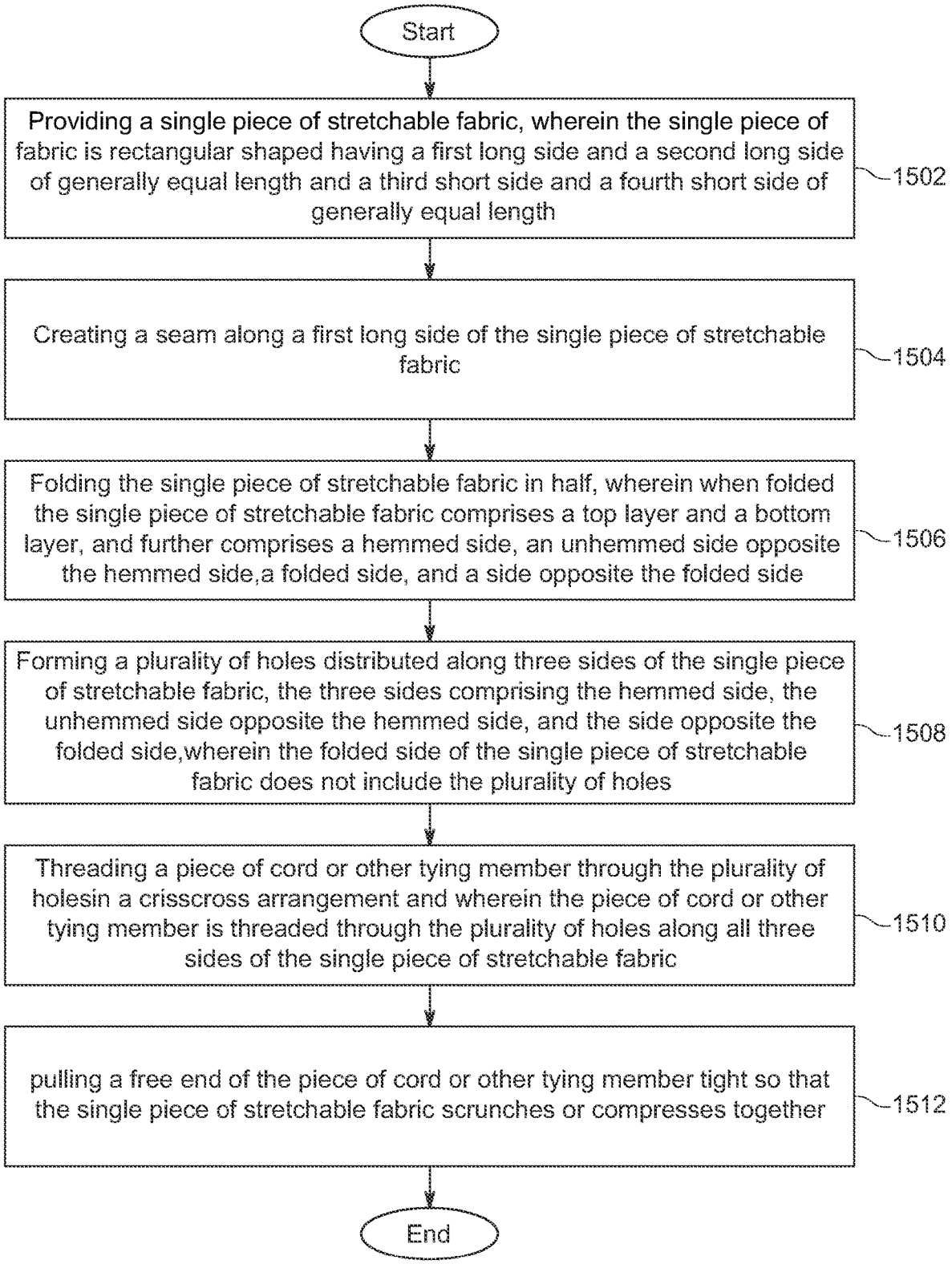
FIG. 15 is a flowchart for an exemplary method of making the scrunch cap in accordance with an illustrative embodiment.

FIG. 15 shows a flowchart for an exemplary method of making a scrunch cap 102. In one or more non-limiting embodiments, at step 1502, the method may include providing a single piece of stretchable fabric 402, whereby the stretchable fabric is generally rectangular shaped and includes a first long side 403 and a second long side 405 of generally equal length and a third short side 402 and a fourth short side 404 of generally equal length, as shown in FIG. 4. At step 1504, the method may include creating a seam 602, as shown in FIG. 6, along a first long side 403 of the single piece of stretchable fabric. At step 1506, the method may include folding the single piece of stretchable fabric 402 in half, whereby when folded the single piece of stretchable fabric 402 comprises a top layer 804 and a bottom layer 806, and further comprises a hemmed side 808, an unhemmed side 810 opposite the hemmed side, a folded side 814, and a side 812 opposite the folded side 814, as shown in FIG. 8.

At step 1508, the method may include forming a plurality of holes 902 distributed along three sides of the single piece of stretchable fabric, the three sides comprising the hemmed side 808, the unhemmed side 810 opposite the hemmed side, and the side 812 opposite the folded side 814, whereby the folded side 814 of the single piece of stretchable fabric 402 does not include the plurality of holes 902. At step 1510, the method may include threading a piece of cord 204 or other tying member through the plurality of holes 902 in a crisscross arrangement 1304 (e.g., as shown in FIG. 13), whereby the piece of cord 204 or other tying member is threaded through the plurality of holes 902 along all three designated sides (i.e., sides 808, 810, and 812) of the single piece of folded, stretchable fabric 402. At step 1512, the method may include pulling a free end of the piece of cord 204 or other tying member tight so that the single piece of stretchable fabric 402 scrunches or compresses together. The method for making the scrunch cap 102 thus far allows for the maker or other user to make the scrunch cap 102 more adjustable in size or as a non-adjustable scrunch cap 102. Accordingly, the maker may add a toggle, such as toggle 1402, or other mechanism. Alternatively, or additionally, the maker or other user may make the scrunch cap 102 adjustable using the technique shown in FIGS. 12-13 and described above.

As shown in FIGS. 1A-1F, the scrunch cap 102 fits nicely on the forehead of the user and the front portion 106 of the cap 102 lays relatively flat on the front of the head 104. The front portion 106 of the cap is relatively form fitting and conforms to the shape of the head 104 of the user, while the back portion 108 of the cap 102 has more volume and body. As described above and shown in FIGS. 3A and 3B, when the user uses his or her hands to pull on the back portion 108 of the cap 102 when the cap 102 is located on the user's head 104, the user can loosen the scrunching 110 of the back portion 108 of the cap 102. In other words, when the user pulls on the back portion 108 of the cap 102 the crisscross threading of the cord 204 through the plurality of holes 902 is loosened.

It is noted that the fit on a user's head of the cap 102 may be adjusted by lacing the cord 204 through less than all of the holes 902 in the cap 102 whether the cap 102 is the "standard size" or "non-adjustable" cap 102 or the "adjustable" cap 102.

The scrunch cap 102 can be adjustable in various ways. As already noted above, the term "adjustable" may be used to describe that the back portion 108 of the scrunch cap 102 may be more gathered and pulled together (i.e., scrunched or compressed together as shown in FIGS. 1B and 1E) or may be looser and wider and less scrunched in appearance with more body and volume (e.g., as shown in FIGS. 1C and 1F). The term "adjustable" may further be used to indicate that the size and fit of the back portion of the scrunch cap, as described and shown in one or more non-limiting embodiments, may be altered by the user when the lengths of the cord used to tie the scrunch cap are left long and either a toggle 1402 as shown in FIG. 14 (or other mechanism) is added for the user to adjust. Alternatively, the user can thread the longer ends of cord through one or more holes 902 on the back portion of the formed scrunch cap 102 as shown in FIG. 12 and FIG. 13. The scrunch cap 102 advantageously may be adjusted in various ways as discussed above and may better accommodate wearers who have long hair and/or thicker hair.

Further, Advantageously, cap 102 as described herein in one or more non-limiting embodiments may be a more attractive, fashionable type of cap 102 than existing scrub caps and other head coverings. The wearer can play with how compressed or loose the cap 102 appears when worn on the head. Advantageously, cap 102 is washable and may be worn numerous times. Further, any type of stretchable fabric may be used to form cap 102 and may come in a multitude of colors and patterns. For the wearer, cap 102 may prove to be a helpful head covering that does not irritate his or her head and skin even if worn for long periods of time. Another advantage of cap 102 as described above and shown in the Figures is that the wearer can simply tuck their hair within the cap 102. The wearer is not required to fashion or tie up their hair in a bun within the cap 102, which is a common issue with existing scrub caps. One of ordinary skill in the art may understand that many more benefits and advantages may be provided by the cap 102 as described herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A scrunch cap to cover hair, the scrunch cap further comprising:

a single piece of stretchable fabric, wherein the single piece of stretchable fabric is initially cut as a rectangular piece, wherein the rectangular piece comprises a first long side and a second long side having generally equal lengths, and further includes a third short side and a fourth short side having generally equal lengths;

a seam, wherein the seam is included on either a first long side or a second long side of the single piece of stretchable fabric, wherein when folded, the single piece of stretchable fabric comprises a hemmed side, an unhemmed side opposite the hemmed side, a folded side, and a side opposite the folded side;

a plurality of holes distributed along three sides of the folded, single piece of stretchable fabric, the three sides comprising the hemmed side, the unhemmed side opposite the hemmed side, and the side opposite the folded side, wherein the folded side of the single piece of stretchable fabric does not include the plurality of holes, and wherein the plurality of holes extend through a top layer and a bottom layer of the folded single piece of stretchable fabric;

a cord or other tying member, wherein the cord or other tying member is configured to be threaded through the plurality of holes in a crisscross arrangement and pulled tight, wherein the scrunch cap is configured to cover fully the hair of a user when the scrunch cap is worn on a head of the user, and wherein a fit of the scrunch cap can be adjusted from being tight fitting to loose fitting by pulling on a back part of the scrunch cap when the scrunch cap is located on the head of the user so that the scrunch cap is looser fitting and more voluminous at the back part of the scrunch cap.

2. The scrunch cap of claim 1, wherein the seam extends along a front portion of the scrunch cap and has a desired width.

3. The scrunch cap of claim 2, wherein the seam is positioned proximate to an edge of the scrunch cap that is configured to be in contact with a forehead of the user.

4. The scrunch cap of claim 1, wherein a portion or all of the plurality of holes are reinforced.

5. The scrunch cap of claim 4, wherein the portion or all of the plurality of holes are reinforced as buttonholes.

6. The scrunch cap of claim 1, wherein any remaining ends of the cord or other tying member are cut and tied.

7. The scrunch cap of claim 6, wherein the any remaining ends are configured to be tied into a bow.

8. The scrunch cap of claim 6, wherein the any remaining ends are tied into a knot.

9. The scrunch cap of claim 1, wherein any remaining ends of the cord or the other tying member are left long and free.

10. The scrunch cap of claim 9, wherein a toggle is added to the any remaining ends of the cord or the other tying member, and wherein the toggle is configured to be pulled up or down along the any remaining ends of the cord or other tying member to adjust a tightness and fit of the scrunch cap.

11. The scrunch cap of claim 9, wherein a knot is formed by tying the any remaining ends of the cord or the other tying member at a designated hole located on the hemmed side of the single piece of stretchable fabric.

12. The scrunch cap of claim 11, wherein any remaining portion of the any remaining ends are configured to be laced through the remaining plurality of holes and a size and fit of the scrunch cap are adjustable depending on how tight or loose the cord or the other tying member is tied around a back of the scrunch cap by the user.

13. The scrunch cap of claim 11, wherein the plurality of holes is reinforced on the hemmed side.

14. A method for making a scrunch cap, the method comprising:

providing a single piece of stretchable fabric, wherein the single piece of fabric is rectangular shaped having a first long side and a second long side of generally equal length and a third short side and a fourth short side of generally equal length;

creating a seam along a first long side of the single piece of stretchable fabric;

folding the single piece of stretchable fabric in half, wherein when folded, the single piece of stretchable fabric comprises a top layer and a bottom layer, and further comprises a hemmed side, an unhemmed side opposite the hemmed side, a folded side, and a side opposite the folded side;

forming a plurality of holes distributed along three sides of the single piece of stretchable fabric, the three sides comprising the hemmed side, the unhemmed side opposite the hemmed side, and the side opposite the folded side, wherein the folded side of the single piece of stretchable fabric does not include the plurality of holes, wherein the plurality of holes extends through the top layer and the bottom layer of the folded single piece of stretchable fabric;

threading a cord or other tying member through the plurality of holes, wherein the cord or other tying member is threaded in a crisscross arrangement, and further wherein the cord or other tying member is threaded through the plurality of holes along the three sides of the single piece of stretchable fabric; and pulling free ends of the cord or other tying member tight so that the single piece of stretchable fabric scrunches or compresses together.

15. The method of claim 14, wherein pulling on a back portion of a formed scrunch cap, loosens a back portion of the formed scrunch cap and provides a different look and appearance to the formed scrunch cap, wherein the different look and appearances includes having more volume and body in the back portion of the scrunch cap.

16. The method of claim 14, wherein after the cord or other tying member is threaded through less than all of the plurality of holes on the hemmed side, a knot is formed at a designated hole of the plurality of holes positioned on the hemmed side.

17. The method of claim 16, wherein remaining ends of the cord or the other tying member are threaded through any remaining holes of the plurality of holes on the hemmed side in a crisscross manner.

18. The method of claim 17, wherein the remaining ends of the cord or the other tying member are left untied, wherein the user can tie the cord or the other tying member as tightly as desired to adjust a size of the scrunch cap to a head of the user.

19. The method of claim 18, wherein the plurality of holes on the hemmed side are reinforced as buttonholes.

20. The method of claim 14, further comprising, adding a toggle to the free ends of the cord or other tying member.

* * * * *